US008353235B2

(12) United States Patent
Bengoa Rodriguez

(10) Patent No.: US 8,353,235 B2
(45) Date of Patent: Jan. 15, 2013

(54) COUNTER-DIE FOR THE CYLINDERS OF ROTARY DIE CUTTING MACHINES

(75) Inventor: Elias Adolfo Bengoa Rodriguez, Torroso-Mos (ES)

(73) Assignee: Rotary Diecutting Montenegro, S.A., Torroso-Mos (ES)

( * ) Notice: Subject to any disclaimer, the term of this patent is extended or adjusted under 35 U.S.C. 154(b) by 193 days.

(21) Appl. No.: 12/723,258

(22) Filed: Mar. 12, 2010

(65) Prior Publication Data

US 2010/0186568 A1 Jul. 29, 2010
US 2012/0234149 A9 Sep. 20, 2012

Related U.S. Application Data

(63) Continuation of application No. PCT/ES2008/000501, filed on Jul. 16, 2008.

(30) Foreign Application Priority Data

Sep. 14, 2007 (ES) ..... 200702448

(51) Int. Cl.
*B26D 1/20* (2006.01)

(52) U.S. Cl. ..... 83/659; 83/508; 83/347

(58) Field of Classification Search ..... 83/659, 83/347, 348, 689, 699, 700, 658, 508; 101/415.1; 492/40, 48, 45
See application file for complete search history.

(56) References Cited

U.S. PATENT DOCUMENTS

| | | | | |
|---|---|---|---|---|
| 3,285,642 | A | 11/1966 | Sauer et al. | |
| 4,982,639 | A | 1/1991 | Kirkpatrick et al. | |
| 5,515,757 | A * | 5/1996 | O'Connor et al. | 83/347 |
| 5,906,149 | A * | 5/1999 | Montenegro Criado | 83/659 |
| 2006/0191390 | A1 * | 8/2006 | Neal | 83/347 |

FOREIGN PATENT DOCUMENTS

WO WO 9711823 A1 4/1997

OTHER PUBLICATIONS

International Search Report, Nov. 17, 2008, PCT/ES2008/000501.

* cited by examiner

*Primary Examiner* — Ghassem Alie
(74) *Attorney, Agent, or Firm* — Merchant & Gould P.C.

(57) ABSTRACT

A counter-die includes a tubular body, divided into several parts (1-1'-1") and joined to each other by tongue and groove joints using twisted edges (2) at the ends, preferentially three parts, these having an inner sector (3) which is the largest, of injected plastic, very resistant and light, over the exterior surface of which there is a coating (4) of polyurethane. The parts are joined to each other by orifices (7) and grooves (8) in their ends, more specifically in the area made of injected plastic, through which respective rods or pins (11) pass.

2 Claims, 2 Drawing Sheets

COUNTER-DIE FOR THE CYLINDERS OF ROTARY DIE CUTTING MACHINES

This application is a Continuation of PCT/ES2008/000501, filed 16 Jul. 2008, which claims benefit of Serial No. P200702448, filed 14 Sep. 2007 in Spain. To the extent appropriate, a claim of priority is made to each of the above disclosed applications.

OBJECT OF THE INVENTION

This invention refers to a counter-die or dolly, that is, an element which is used to cover the cylinder on which the die acts, with the aim of preventing damage to the blades of the latter.

The object of the invention is to attain a counter-die that is easy and fast to fit onto the cylinder, with a long useful life and which improves the expulsion of residues after stamping, as well as a series of additional advantages that will be described throughout this document.

BACKGROUND OF THE INVENTION

As it is known, in rotary stamping machines two cylinders work, between which the piece to be stamped is placed, while one of the cylinders includes the blades of the die itself, while the other functions as the stamping base.

This cylinder that works as the base for stamping is made of steel, and to ensure that the blades of the die are not damaged during stamping, it is equipped with a dolly made of a relatively soft material, usually polyurethane.

More specifically, the said dolly takes the form of a thick band that surrounds the cylinder, I.e., it forms a type of casing that is also cylindrical, with the particularity that it has two metal shapes in the area of its opening, which together form a key that fits into a groove or keyway, where in some cases the said key is affixed by bolts and in others by different means.

The problem with dollies or counter-dies of this type is that they do not have good dimensional stability that would make it possible to maintain the circumferential diameter throughout the whole lifetime of the device, as its support lacks rigidity, making them liable to suffer dilation due to thermal effects.

Additionally it should be pointed out that devices of this type are difficult to implement, giving rise to high maintenance costs due to the long times machines have to be taken out of service so that they can be replaced.

Apart from the problem described above, it also has to be said that counter-dies do not usually fit the cylinder perfectly, making it possible for them to move in certain ways that are negative for the stamping process.

DESCRIPTION OF THE INVENTION

The counter-die proposed resolves the above problems in a fully satisfactory way, in all of the different aspects mentioned.

To this end and more specifically, the said counter-die takes the form of a tubular body, based on two layers, one thicker interior layer obtained using injected plastic, rigid, consistent and with very stable dimensions, and an exterior layer or coating based on vulcanized consumable polyurethane, which ensures any possible dilations that occur are minimum, as well as more regular and uniform.

The said set therefore offers maximum dimensional stability, making it possible to keep a uniform diameter of circumference throughout the whole useful life of the device.

According to another of the characteristics of the invention, the said tubular body that forms the counter-die is divided into a series of parts that may be fitted together circumferentially, preferentially three parts, including a connection system that makes the maneuver of replacing the said counter-die extremely fast and simple, as it is composed of parts which are very light in weight and easy to handle, notably reducing the times that the machine is out of service.

More specifically, the connection system between the parts that make up the counter-die takes the form of a tongue and groove joint around the edge at each end of each part, in such a way that in one of the said ends, and corresponding to the sector obtained using injected plastic, there is a hole that passes through, while on the opposite one there is an "L" shaped groove, so that when connecting the tongue and groove joint between opposite ends of the three parts, respective rods are simultaneously inserted and pass through the through-holes as well as through the "L" shaped grooves, making it possible for the said rods to move along the said "L" shaped grooves, thereby aiding the maneuver of assembly, as gaps are permitted when the said rods are located on the long section of the said "L" shaped groove, while they are perfectly connected and fitted according to their size when they are moved to the final position of assembly, that which corresponds to their position over the short arm or section of the "L".

It is designed so that the interior diameter of the device will be greater than that of the cylinder on which polyurethane is fitted, making the effect of a "bearing" or of free turning on the cylinder possible, an advantage which permits the die to move relatively to the counter-die while working at the same speed and preventing tears and excessive forces, which increases the lifespan of the counter-die and the die itself, while also obtaining increasing stability of the dimensions of the stamped plate.

It should be underlined that the sector or interior parts of the counter-die, those which are obtained using injected plastic, are reusable elements, thereby reducing the problem of waste elimination and decreasing environmental impact.

According to another one of the characteristics of the invention, it has been designed so that the system is equipped with a set of rings located on the ends of the cylinder, which make it possible to control the total dilation of the set as well as to restrict the lateral movement of the units on the cylinder.

In this way the polyurethane lasts for longer, permitting major savings in the consumption of covers, as well as a series of advantages, among which the following stand out:

- It always permits stamping with a stable, minimum and constant penetration of the blade.
- It offers perfect control of the measurements of the box to be stamped.
- Wear of the polyurethane layer is uniform.
- The expulsion of wastes and residues is improved, especially when working at low pressure.
- It improves the marking of splits without breaking the paper inside.
- It makes it possible to use cut-split bands without going through the paper.
- Less maintenance.
- Increased productivity due to the shorter times when the machine is out of service due to rotation of the polyurethane sections or repairs to the die.
- The interior elements are reusable, and it is possible to collect the unused polyurethane.

It is possible to produce complicated designs of boxes that to date could only be stamped using flat stampers.

DESCRIPTION OF THE DRAWINGS

To complement the description being given and with the aim of aiding better comprehension of the characteristics of the invention, according to a preferential example of the practical execution of the same, the said description is accompanied, as an integral part of the same, by a set of drawings in which as illustrations and not restrictively, the following are shown.

PREFERRED EMBODIMENT OF THE INVENTION

In the light of the said figures, it may be seen that the counter-die proposed by the invention takes the form of a tubular body, obtained on the basis of three parts (1-1'-1") which are joined together, for which purpose they have an edge (2) that is bent and complementary respecting its opposite edge, in order to create the means of groove and tongue connection and a continuous surface for the said tubular body.

Figure 2:
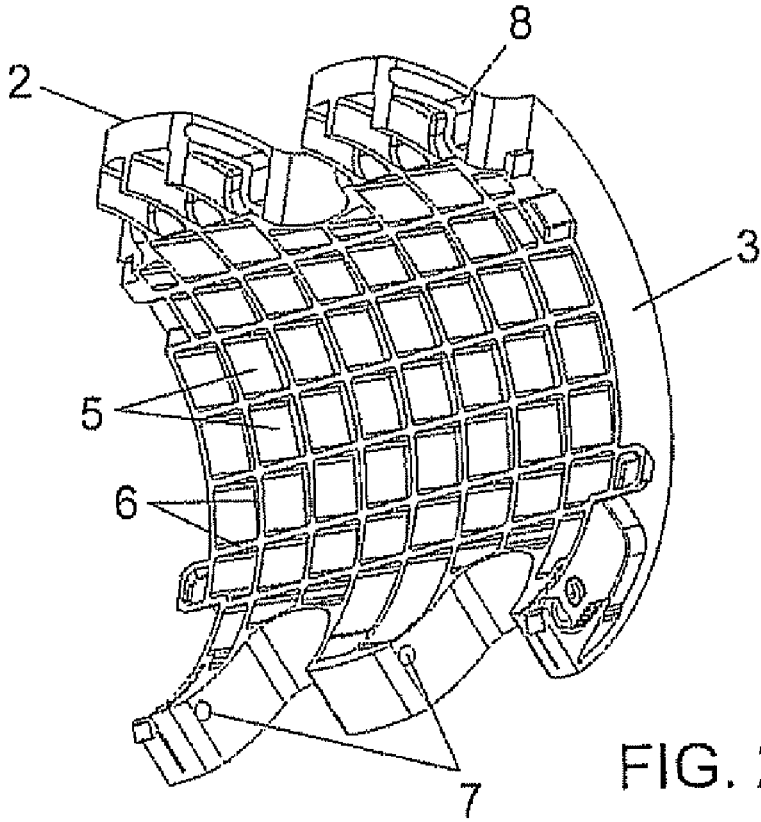
FIG. 2. This show a detail in perspective of one of the parts of the counter-die, without the external cover of polyurethane.

As may be observed in FIG. 2, the said parts (1-1'-1") include a sector that is interior and the largest (3), made from injected plastic, together with an exterior coating of polyurethane (4) applied by means of vulcanization.

Figure 1:
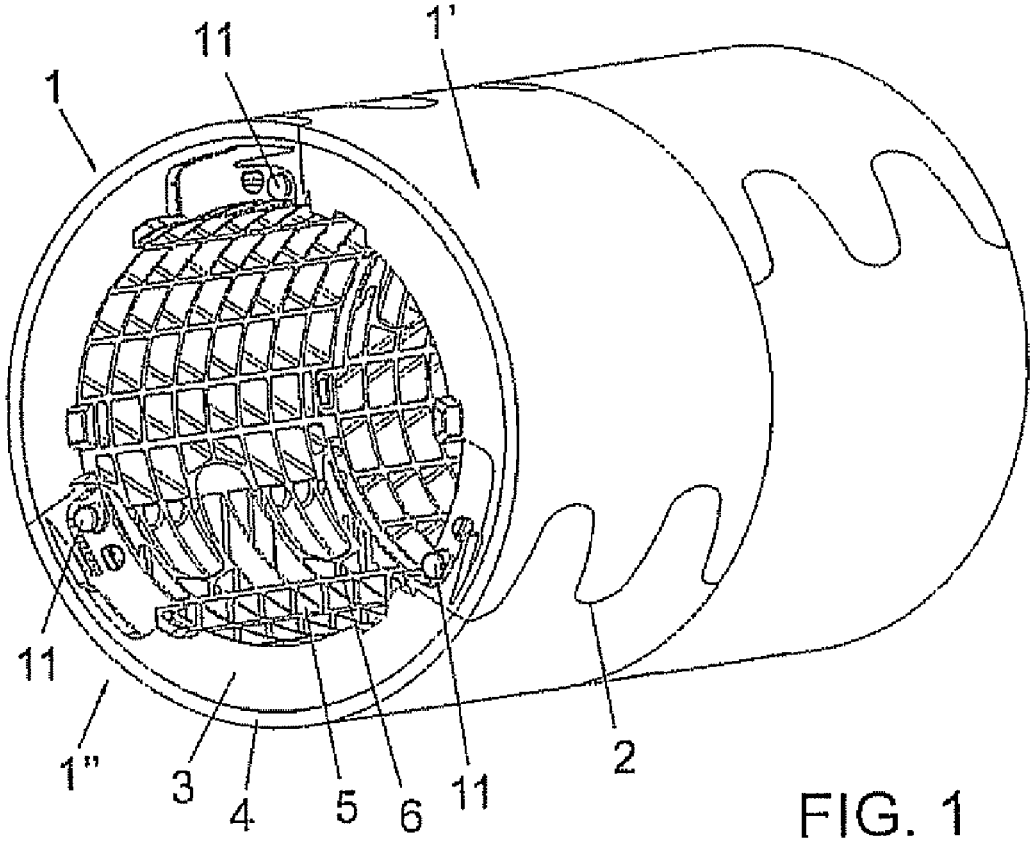
FIG. 1. This shows, according to a diagrammatic representation in perspective, a counter-die executed according to the object of the invention.

To make the said parts (1-1'-1") elements which are light and easy to handle, they are equipped on their inner surface with sunken areas (5) which form brackets (6) that increase rigidity, all as may be seen in FIG. 1.

Figure 3:
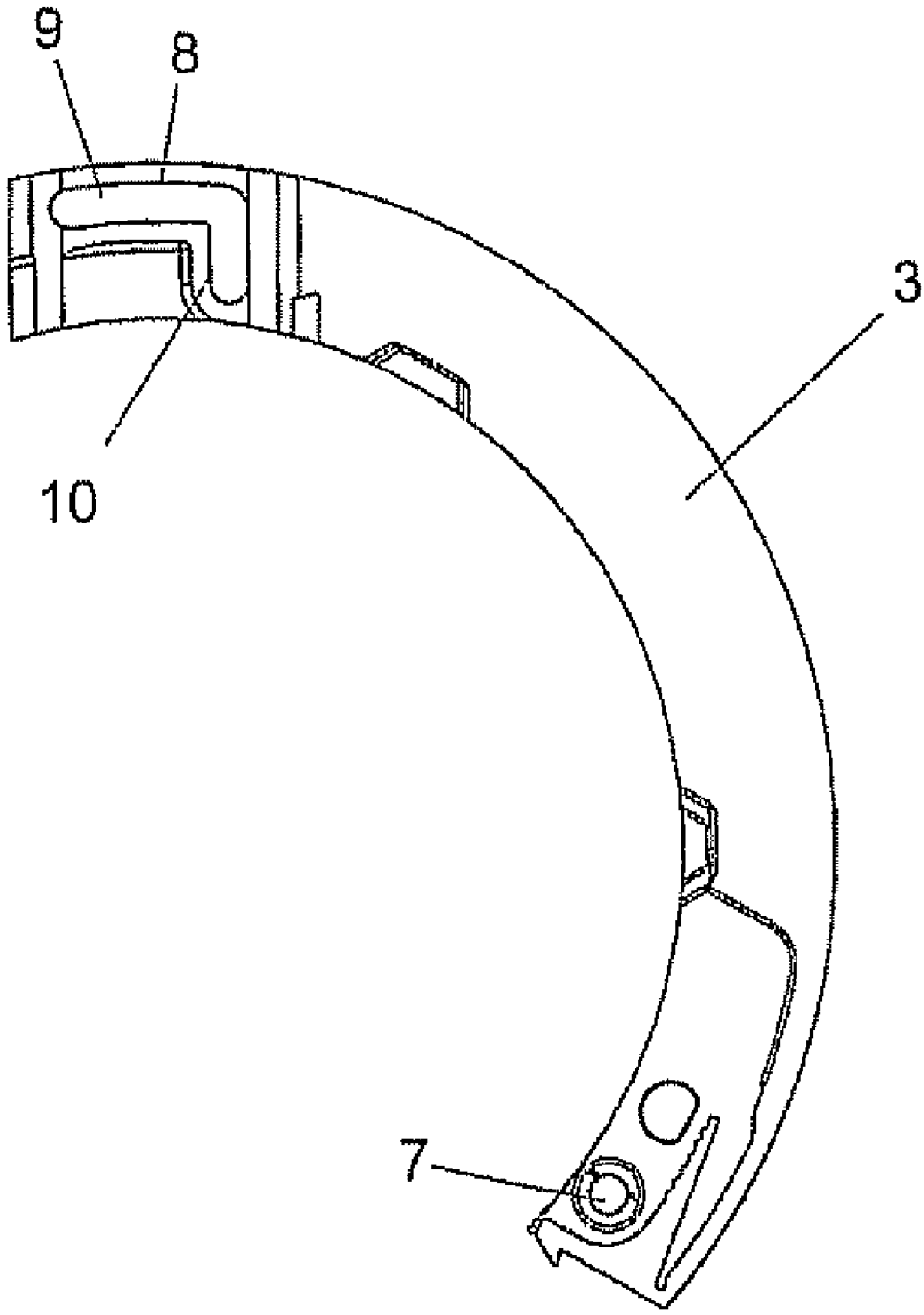
FIG. 3. this shows a side view of the same part as the previous figure.

Regarding the means for affixing the three parts (1-1'-1") to each other, they are equipped, at the level of their internal sector (3) of injected plastic, and on one of their ends, with an orifice (7) that passes through the same, which acts on the protuberances created by the bent edge (2) described above, while at its other end, as may be observed in FIG. 2 and FIG. 3, it includes an "L" shaped groove (8) having a sector (9) and an elbow (10), which when ready for assembly is opposed to the hole (7), in order to permit the insertion of a fixing rod (11) through the grooves (8) and holes (7), as shown in FIG. 1, which is able to move along the sector (9) of the "L" shaped groove (8), facilitating the maneuvers of assembling the device, as it allows the play of the fixing rod over the sector (9) to increase the internal diameter of the device and thereby to offer a gap to make it easier to put into position, so that when the parts are pressed together, the rod (11) moves to the elbow (10) of the groove (8), locking into place and achieving the perfect fit of the device.

The counter-die is complemented, as was pointed out above, with a set of limiting rings, which may be adjustable or fixed, and which are placed over the ends of the cylinder, making it possible to control the dilation of the device and to restrict the lateral movement of the units on the cylinder.

The invention claimed is:

1. A counter-die for cylinders of a rotary die-cutting machine to cover a cylinder on which the die acts, comprising:

a tubular body, divided into a plurality of parts fitted together using tongue and groove joints, in sets of three, the plurality of parts having an inner sector of injected plastic, which is the largest of the parts; an exterior face of the tubular body is coated in polyurethane, wherein the parts include a quick connection;

said parts having bent edges on ends for connecting the parts to each other, and said quick connection includes through orifices that act on protruding edges formed by a bent edge on one end of an intermediate sector of injected plastic, and "L" shaped grooves having a first section and an elbow in protruding edges of an opposite end, being configured so that when configured for assembly, the grooves are opposed to the orifices;

respective fixing rods passing through the orifices and grooves for coupling.

2. Counter-die for the cylinders of rotary die-cutting machines, according to claim 1, wherein the intermediate sector, made from injected plastic, has on an inner surface a plurality of sunken areas to make the intermediate sector lighter, the inner surface forming brackets.

* * * * *